US009630251B2

(12) United States Patent
Jacobsen et al.

(10) Patent No.: US 9,630,251 B2
(45) Date of Patent: Apr. 25, 2017

(54) TITANIUM ALLOY

(71) Applicant: Cristal Metals Inc., Hunt Valley, MD (US)

(72) Inventors: Lance E. Jacobsen, Minooka, IL (US); Adam Benish

(73) Assignee: Cristal Metals Inc., Hunt Valley, MD (US)

( * ) Notice: Subject to any disclaimer, the term of this patent is extended or adjusted under 35 U.S.C. 154(b) by 331 days.

(21) Appl. No.: 14/521,646

(22) Filed: Oct. 23, 2014

(65) Prior Publication Data

US 2015/0040726 A1 Feb. 12, 2015

Related U.S. Application Data

(63) Continuation of application No. 12/879,598, filed on Sep. 10, 2010, now Pat. No. 8,894,738, which is a continuation of application No. 11/186,724, filed on Jul. 21, 2005, now abandoned.

(51) Int. Cl.

| | |
|---|---|
| ***B22F 1/00*** | (2006.01) |
| ***B22F 9/28*** | (2006.01) |
| ***C22B 34/12*** | (2006.01) |
| ***C22C 1/04*** | (2006.01) |
| ***C22C 14/00*** | (2006.01) |

(52) U.S. Cl.

CPC ..... *B22F 9/28* (2013.01); *B22F 1/0003* (2013.01); *B22F 1/0011* (2013.01); *C22B 34/1272* (2013.01); *C22C 1/0458* (2013.01); *C22C 14/00* (2013.01); *B22F 2301/205* (2013.01); *B22F 2998/00* (2013.01)

(58) Field of Classification Search

CPC . C22C 14/00; C22C 1/0458; B22F 2301/205; C22B 34/10

USPC ..... 75/343

See application file for complete search history.

(56) References Cited

U.S. PATENT DOCUMENTS

| | | | |
|---|---|---|---|
| 1,771,928 | A | 7/1930 | Jung |
| 2,205,854 | A | 6/1940 | Kroll |
| 2,607,675 | A | 8/1952 | Gross |

(Continued)

FOREIGN PATENT DOCUMENTS

| | | |
|---|---|---|
| AU | 587782 | 11/1985 |
| AU | 2003263081 | 6/2004 |

(Continued)

OTHER PUBLICATIONS

Kelto et al. "Titanium Powder Metallurgy—A Perspective"; Conference: Powder Metallurgy of Titanium Alloys, Las Vegas, Nevada, Feb. 1980, pp. 1-19.

(Continued)

*Primary Examiner* — Jie Yang

(57) ABSTRACT

A titanium base alloy powder is formed by subsurface reduction of a chloride vapor with a molten alkali metal or molten alkaline earth metal to form reaction products comprising pre-alloy particles and a salt of the alkali metal or the alkaline earth metal. A majority of the pre-alloy particles have a composition of at least 50% by weight of titanium, about 5.38% to 6.95% by weight of aluminum, and about 3% to 5% by weight of vanadium. The pre-alloy particles are recovered from the reaction products to produce a titanium base alloy powder containing less than about 200 ppm alkali or alkaline earth metal.

12 Claims, 12 Drawing Sheets

(56) References Cited

U.S. PATENT DOCUMENTS 2,647,826 A 8/1953 Jordan
2,816,828 A 12/1957 Benedict et al.
2,823,991 A 2/1958 Kamlet
2,827,371 A 3/1958 Quin
2,835,567 A 5/1958 Willcox
2,846,303 A 8/1958 Keller et al.
2,846,304 A 8/1958 Keller et al.
2,882,143 A 4/1959 Schmidt
2,882,144 A 4/1959 Follows et al.
2,890,112 A 6/1959 Winter
2,895,823 A 7/1959 Lynskey
2,915,382 A 12/1959 Hellier et al.
2,941,867 A 6/1960 Maurer
2,944,888 A 7/1960 Quin
3,058,820 A 10/1962 Whitehurst
3,067,025 A 12/1962 Chisholm
3,085,871 A 4/1963 Griffiths
3,085,872 A 4/1963 Kenneth
3,113,017 A 12/1963 Homme
3,331,666 A 7/1967 Robinson et al.
3,519,258 A 7/1970 Ishizuka
3,535,109 A 10/1970 Ingersoll
3,650,681 A 3/1972 Sugahara et al.
3,825,415 A 7/1974 Johnston et al.
3,836,302 A 9/1974 Kaukeinen
3,847,596 A 11/1974 Holland et al.
3,867,515 A 2/1975 Bohl et al.
3,919,087 A 11/1975 Brumagim
3,927,993 A 12/1975 Griffin
3,943,751 A 3/1976 Akiyama et al.
3,966,460 A 6/1976 Spink
4,007,055 A 2/1977 Whittingham
4,009,007 A 2/1977 Fry
4,017,302 A 4/1977 Bates et al.
4,070,252 A 1/1978 Bonsack
4,128,421 A 12/1978 Marsh et al.
4,141,719 A 2/1979 Hakko
4,149,876 A 4/1979 Rerat
4,190,442 A 2/1980 Patel
4,331,477 A 5/1982 Kubo et al.
4,373,947 A * 2/1983 Buttner ..... C22B 34/1268 75/228
4,379,718 A 4/1983 Grantham et al.
4,401,467 A 8/1983 Jordan
4,402,741 A 9/1983 Pollet et al.
4,414,188 A 11/1983 Becker
4,423,004 A 12/1983 Ross
4,425,217 A 1/1984 Beer
4,432,813 A 2/1984 Williams
4,445,931 A 5/1984 Worthington
4,454,169 A 6/1984 Hinden et al.
4,518,426 A 5/1985 Murphy
4,519,837 A 5/1985 Down
4,521,281 A 6/1985 Kadija
4,555,268 A 11/1985 Getz
4,556,420 A 12/1985 Evans et al.
4,604,368 A 8/1986 Reeve
4,606,902 A 8/1986 Ritter
RE32,260 E 10/1986 Fry
4,687,632 A 8/1987 Hurd
4,689,129 A 8/1987 Knudsen
4,725,312 A 2/1988 Seon et al.
4,828,008 A 5/1989 White et al.
4,830,665 A 5/1989 Winand
4,839,120 A 6/1989 Baba et al.
4,877,445 A 10/1989 Okudaira et al.
4,897,116 A 1/1990 Scheel
4,902,341 A 2/1990 Okudaira et al.
4,915,729 A 4/1990 Boswell et al.
4,923,577 A 5/1990 McLaughlin et al.
4,940,490 A 7/1990 Fife et al.
4,941,646 A 7/1990 Stelts et al.
4,985,069 A 1/1991 Traut
5,028,491 A 7/1991 Huang et al.
5,032,176 A 7/1991 Kametani et al.
5,055,280 A 10/1991 Nakatani et al.
5,064,463 A 11/1991 Ciomek
5,082,491 A 1/1992 Rerat
5,147,451 A 9/1992 Leland
5,149,497 A 9/1992 McKee et al.
5,160,428 A 11/1992 Kuri
5,164,346 A 11/1992 Giunchi et al.
5,167,271 A 12/1992 Lange et al.
5,176,741 A 1/1993 Bartlett et al.
5,176,810 A 1/1993 Volotinen et al.
5,211,741 A 5/1993 Fife
5,259,862 A 11/1993 White et al.
5,338,379 A 8/1994 Kelly
5,356,120 A 10/1994 König et al.
5,427,602 A 6/1995 DeYoung et al.
5,437,854 A 8/1995 Walker et al.
5,439,750 A 8/1995 Ravenhall et al.
5,448,447 A 9/1995 Chang
5,460,642 A 10/1995 Leland
5,498,446 A 3/1996 Axelbaum et al.
5,580,516 A 12/1996 Kumar
H1642 H 4/1997 Jenkins
5,637,816 A 6/1997 Schneibel
5,779,761 A 7/1998 Armstrong et al.
5,897,830 A 4/1999 Abkowitz et al.
5,914,440 A 6/1999 Celik et al.
5,948,495 A 9/1999 Stanish et al.
5,951,822 A 9/1999 Knapick et al.
5,954,856 A 9/1999 Pathare et al.
5,958,106 A 9/1999 Armstrong et al.
5,986,877 A 11/1999 Pathare et al.
5,993,512 A 11/1999 Pargeter et al.
6,010,661 A 1/2000 Abe et al.
6,027,585 A 2/2000 Patterson et al.
6,040,975 A 3/2000 Mimura
6,099,664 A 8/2000 Davies
6,103,651 A 8/2000 Leitzel
6,136,062 A 10/2000 Loffeholz et al.
6,180,258 B1 1/2001 Klier
6,193,779 B1 2/2001 Reichert et al.
6,210,461 B1 4/2001 Elliott
6,238,456 B1 5/2001 Wolf et al.
6,309,570 B1 10/2001 Fellabaum
6,309,595 B1 10/2001 Rosenberg et al.
6,409,797 B2 6/2002 Armstrong et al.
6,432,161 B1 8/2002 Oda et al.
6,488,073 B1 12/2002 Blenkinsop et al.
6,502,623 B1 1/2003 Schmitt
6,602,482 B2 8/2003 Kohler et al.
6,689,187 B2 2/2004 Oda
6,727,005 B2 4/2004 Gimondo et al.
6,745,930 B2 6/2004 Schmitt
6,824,585 B2 11/2004 Joseph et al.
6,861,038 B2 3/2005 Armstrong et al.
6,884,522 B2 4/2005 Adams et al.
6,902,601 B2 6/2005 Nie et al.
6,921,510 B2 7/2005 Ott et al.
6,955,703 B2 10/2005 Zhou et al.
7,041,150 B2 5/2006 Armstrong et al.
7,351,272 B2 4/2008 Armstrong et al.
7,410,610 B2 8/2008 Woodfield et al.
7,435,282 B2 10/2008 Armstrong et al.
7,445,658 B2 11/2008 Armstrong et al.
7,501,007 B2 3/2009 Anderson et al.
7,501,089 B2 3/2009 Armstrong et al.
2002/0005090 A1 1/2002 Armstrong et al.
2002/0050185 A1 5/2002 Oda
2002/0152844 A1 10/2002 Armstrong et al.
2002/0194953 A1 12/2002 Rosenberg et al.
2003/0061907 A1 4/2003 Armstrong et al.
2003/0145682 A1 8/2003 Anderson et al.
2003/0230170 A1 * 12/2003 Woodfield ..... B22F 3/001 75/613
2004/0123700 A1 7/2004 Zhou et al.
2005/0081682 A1 4/2005 Armstrong et al.
2005/0150576 A1 7/2005 Venigalla
2005/0225014 A1 10/2005 Armstrong et al.
2005/0284824 A1 12/2005 Anderson et al.
2006/0086435 A1 4/2006 Anderson et al.

(56) References Cited

U.S. PATENT DOCUMENTS

| | | | |
|---|---|---|---|
| 2006/0102255 | A1 | 5/2006 | Woodfield et al. |
| 2006/0107790 | A1 | 5/2006 | Anderson et al. |
| 2006/0123950 | A1 | 6/2006 | Anderson et al. |
| 2006/0150769 | A1 | 7/2006 | Armstrong et al. |
| 2006/0230878 | A1 | 10/2006 | Anderson et al. |
| 2007/0017319 | A1 | 1/2007 | Jacobsen et al. |
| 2007/0079908 | A1 | 4/2007 | Jacobsen et al. |
| 2007/0180951 | A1 | 8/2007 | Armstrong et al. |
| 2007/0180952 | A1 | 8/2007 | Lanin et al. |
| 2008/0031766 | A1 | 2/2008 | Kogut et al. |
| 2008/0152533 | A1 | 6/2008 | Ernst et al. |
| 2008/0187455 | A1 | 8/2008 | Armstrong et al. |
| 2008/0199348 | A1 | 8/2008 | Armstrong et al. |

FOREIGN PATENT DOCUMENTS

| | | |
|---|---|---|
| CA | 2196534 | 2/1996 |
| EP | 0298698 | 1/1989 |
| EP | 0299791 | 1/1989 |
| EP | 1441039 | 7/2004 |
| EP | 1657317 | 5/2006 |
| GB | 722184 | 1/1955 |
| GB | 778021 | 7/1957 |
| JP | 31007808 | 9/1956 |
| JP | 49042518 | 4/1974 |
| JP | 51010803 | 4/1976 |
| JP | 60255300 | 12/1985 |
| JP | 6112837 | 1/1986 |
| JP | 62065921 | 3/1987 |
| JP | 64047823 | 2/1989 |
| JP | 4116161 | 4/1992 |
| JP | 05078762 | 3/1993 |
| JP | 10502418 | 3/1998 |
| JP | 11090692 | 4/1999 |
| JP | 2001279345 | 10/2001 |
| NO | 90840 | 1/1958 |
| SU | 411962 | 1/1974 |
| WO | WO96/04407 | 2/1996 |
| WO | WO98/24575 | 6/1998 |
| WO | WO2004/022269 | 3/2004 |
| WO | WO2004/022797 | 3/2004 |
| WO | WO2004/022798 | 3/2004 |
| WO | WO2004/022799 | 3/2004 |
| WO | WO2004/022800 | 3/2004 |
| WO | WO2004/026511 | 4/2004 |
| WO | WO2004/028655 | 4/2004 |
| WO | WO2004/033736 | 4/2004 |
| WO | WO2004/033737 | 4/2004 |
| WO | WO2004/048622 | 10/2004 |
| WO | WO2005/019485 | 3/2005 |
| WO | WO2005/021807 | 3/2005 |
| WO | WO2005/023725 | 3/2005 |
| WO | WO2005/042792 | 5/2005 |
| WO | WO2007/044635 | 4/2007 |
| WO | WO2007/089400 | 8/2007 |
| WO | WO2008/013518 | 1/2008 |
| WO | WO2008/079115 | 7/2008 |

OTHER PUBLICATIONS

Mahajan et al. "Microstructure Property Correlation in Cold Pressed and Sintered Elemental Ti-6A1-4V Powder Compacts"; Conference: Powder Metallurgy of Titanium Alloys, Las Vegas, Nevada, Feb. 1980, pp. 189-202.

DeKock et al. "Attempted Preparation of Ti-6-4 Alloy Powders from $TiCl_4$, Al, $VCl_4$, and Na"; Metallurgical Transactions B, vol. 18B, No. 1, Process Metallurgy, Sep. 1987, pp. 511-517.

Upadhyaya "Metal Powder Compaction", Powder Metallurgy Technology, Published by Cambridge International Science Publishing, 1997; pp. 42-67.

Moxson et al. "Production and Applications of Low Cost Titanium Powder Products"; The international Journal of Powder Metallurgy, vol. 34, No. 5, 1998, pp. 45-47.

Alt "Solid-Liquid Separation, Introduction"; Ulmann's Encyclopedia of Industrial Chemistry, © 2002 by Wiley-VCH Verlag GmbH & Co., Online Posting Date: Jun. 15, 2000, pp. 1-7.

Gerdemann et al. "Characterization of a Titanium Powder Produced Through a Novel Continuous Process"; Published by Metal Powder Industries Federation, 2000, pp. 12.41-12.52.

Moxson et al. "Innovations in Titanium Powder Processing"; Titanium Overview, JOM, May 2000, p. 24.

Gerdemann "Titanium Process Technologies"; Advanced Materials & Processes, Jul. 2001, pp. 41-43.

Lü et al. "Laser-Induced Materials and Processes for Rapid Prototyping" Published by Springer, 2001, pp. 153-154.

Lee et al. "Synthesis of Nano-Structured Titanium Carbide by Mg-Thermal Reduction"; Scripta Materialia, 2003, pp. 1513-1518.

Chandran et al. "$TiB_w$-Reinforced Ti Composites: Processing, Properties, Application Prospects, and Research Needs"; Ti—B Alloys and Composites Overview, JOM, May 2004, pp. 42-48.

Chandran et al. "Titanium-Boron Alloys and Composites: Processing, Properties, and Applications"; Ti—B Alloys and Composites Commentary, JOM, May 2004 pp. 32 and 41.

Hanusiak et al. "The Prospects for Hybrid Fiber-Reinforced Ti—TiB-Matrix Composites"; Ti—B Alloys and Composites Overview, JOM, May 2004, pp. 49-50.

Kumari et al. "High-Temperature Deformation Behavior of Ti—$TiB_w$ In-Situ Metal-Matrix Composites"; Ti—B Alloys and Composites Research Summary, JOM, May 2004, pp. 51-55.

Saito "The Automotive Application of Discontinuously Reinforced TiB—Ti Composites"; Ti—B Alloys and Composites Overview, JOM, May 2004, pp. 33-36.

Yolton "The Pre-Alloyed Powder Metallurgy of Titanium with Boron and Carbon Additions"; Ti—B Alloys and Composites Research Summary, JOM, May 2004, pp. 56-59.

Research Report; P/M Technology News, Crucible Research, Aug. 2005, vol. 1, Issue 2, 2 pages.

Peter et al, "Structure and properties of titanium and titanium alloys", book edited by Leyens et al, Titanium and titanium alloys, Wiley-VCHGmbH&Co. KGaA, copyright 2003, pp. 1-23.

* cited by examiner

TITANIUM ALLOY

CROSS REFERENCE TO RELATED APPLICATIONS/INCORPORATION BY REFERENCE STATEMENT

The present application is a continuation of U.S. Ser. No. 12/879,598, filed Sep. 10, 2010; which is a continuation of U.S. Ser. No. 11/186,724, filed Jul. 21, 2005, now abandoned. The entire contents of each of the above-referenced patent applications are hereby expressly incorporated herein by reference.

FIELD OF THE INVENTION

This invention relates to alloys of titanium having at least 50% titanium and most specifically to an alloy of titanium particularly useful in the aerospace and defense industries known as 6/4 which is about 6% by weight aluminum and about 4% by weight vanadium with the balance titanium and trace materials as made by the Armstrong process.

BACKGROUND OF THE INVENTION

The ASTM B265 grade 5 chemical specifications for 6/4 require that vanadium is present in the amount of 4%±1% by weight and aluminum is present in the range of from about 5.5% to about 6.75% by weight. The alloy of the invention is produced by the Armstrong Process as previously disclosed in U.S. Pat. Nos. 5,779,761; 5,958,106 and 6,409,797, the entire disclosures of which are herein incorporated by reference. The aforementioned patents teach the Armstrong Process as it relates to the production of various materials including alloys. The Armstrong Process includes the subsurface reduction of halides by a molten metal alkali or alkaline earth element or alloy. The development of the Armstrong Process has occurred from 1994 through the present, particularly as it relates to the production of titanium and its alloys using titanium tetrachloride as a source of titanium and using sodium as the reducing agent. Although this invention is described particularly with respect to titanium tetrachloride, aluminum trichloride and vanadium tetrachloride and sodium as a reducing metal, it should be understood that various halides other than chlorine can be used and various reductants other than sodium can be used and the invention is broad enough to include those materials.

However, because the Armstrong Process over the past eleven years has been developed using molten sodium and chlorides, it is these materials which are referenced herein. During the production of titanium by the Armstrong Process, as disclosed in the previous patents, the steady state temperature of the reaction can be controlled by the amount of reductant metal and the amount of chloride being introduced. Although it is feasible to control the reaction temperature by varying the chloride concentration while keeping the amount of molten metal constant, the preferred method is to control the temperature of the reactant products by varying the amount of excess (over stoichiometric) reductant metal introduced into the reaction chamber. Preferably, the reaction is maintained at a steady state temperature of about 400° C. and at this temperature, as previously disclosed, the reaction can be maintained for very long periods of time without damage to the equipment while producing a relatively uniform product.

Heretofore, commercially pure (CP) titanium ASTM 8265 grades 1, 2, 3 and 4 have been produced in over two hundred runs using the Armstrong Process and although a wide variety of operating parameters have been tested, certain results are inherent in the process. The ASTM B 265 spec sheet follows:

TABLE 1

| Chemical Requirements | | | | | | | | | | |
|---|---|---|---|---|---|---|---|---|---|---|
| | Composition % Grade | | | | | | | | | |
| Element | 1 | 2 | 3 | 4 | 5 | 6 | 7 | 8 | 9 | 10 |
| Nitrogen max | 0.03 | 0.03 | 0.05 | 0.05 | 0.05 | 0.05 | 0.03 | 0.02 | 0.03 | 0.03 |
| Carbon max | 0.10 | 0.10 | 0.10 | 0.10 | 0.10 | 0.10 | 0.10 | 0.10 | 0.10 | 0.08 |
| Hydrogen[B] max | 0.015 | 0.015 | 0.015 | 0.015 | 0.015 | 0.020 | 0.015 | 0.015 | 0.015 | 0.015 |
| Iron Max | 0.20 | 0.30 | 0.30 | 0.50 | 0.40 | 0.50 | 0.30 | 0.25 | 0.20 | 0.30 |
| Oxygen max | 0.18 | 0.25 | 0.35 | 0.40 | 0.20 | 0.20 | 0.25 | 0.15 | 0.18 | 0.25 |
| Aluminum | — | — | — | — | 5.5 to 6.75 | 4.0 to 6.0 | — — | 2.5 to 3.5 | — — | — — |
| Vanadium | — | — | — | — | 3.5 to 4.5 | — | — | | 2.0 to 3.0 | |
| Tin | — | — | — | — | — | 2.0 to 3.0 | — — | — — | — — | — — |
| Palladium | — | — | — | — | — | — | 0.12 to 0.25 | — | 0.12 to 0.25 | — |
| Molybdenum | — | — | — | — | — | — | — | — | — | 0.2 to 0.4 |
| Zirconium | — | — | — | — | — | — | — | — | — | — |
| Nickel | — | — | — | — | — | — | — | — | — | 0.6 to 0.9 |
| Residuals [C,D,E.] (each), max | 0.1 | 0.1 | 0.1 | 0.1 | 0.1 | 0.1 | 0.1 | 0.1 | 0.1 | 0.1 |
| Residuals [C,D,E.] (total) max | 0.4 | 0.4 | 0.4 | 0.4 | 0.4 | 0.4 | 0.4 | 0.4 | 0.4 | 0.4 |
| Titanium[F] | remainder | remainder | remainder | remainder | remainder | remainder | remainder | remainder | remainder | remainder |

[A] Analysis shall be completed for all elements listed in this Table for each grade. The analysis results for the elements not quantified in the Table need not be reported unless the concentration level is greater than 0.1% each or 0.4% total.

[B] Lower hydrogen may be obtained by negotiation with the manufacturer.

[C] Need not be reported.

[D] A residual is an element present in a metal or an alloy in small quantities inherent to the manufacturing process but not added intentionally.

TABLE 1-continued

| Chemical Requirements | | | | | | | | | | |
|---|---|---|---|---|---|---|---|---|---|---|
| | Composition % Grade | | | | | | | | | |
| Element | 1 | 2 | 3 | 4 | 5 | 6 | 7 | 8 | 9 | 10 |

[E] The purchaser may, in his written purchase order, request analysis for specific residual elements not listed in this specification. The maximum allowable concentration for residual elements shall be 0.1% each and 0.4% maximum total.
[F] The percentage of titanium is determined by difference.

Production of titanium powder by the Armstrong Process inherently produces powder in which the average diameter of individual particle is less than a micron. During distillation at 500 to 600° C., the particles agglomerate and have an average agglomerated particle diameter in the range of from about 3.3 to about 1.3 microns. Particle diameters are based on a calculated size of a sphere from a surface area, such as BET. For agglomerated particles, the calculated average diameters were based on surface are measurements in a range of from about 0.4 to about 1.0 $m^2$ per gram. In over two hundred runs, the titanium powder produced by the Armstrong Process always has a packing fraction in the range of from about 4% to about 11% which also may also be expressed as tap density. Tap density is a well known characteristic and is determined by introducing the powder into a graduated test tube and tapping the tube until the powder is fully settled. Thereafter, the weight of the powder is measured and the packing fraction or percent of theoretical density is calculated.

Moreover, during the production of CP titanium by the Armstrong Process, a certain amount of sodium has always been retained even after extensive distillation, including vacuum distillation, and this retained sodium has been present on average of about 500-700 ppm, and has rarely been below about 400 ppm. From a commercial point of view, significant effort is and has been expended in order to reduce the sodium content of CP titanium made by the Armstrong Process.

Prior to the Armstrong Process, CP titanium powder and titanium alloy powder traditionally have been made by two methods, hydride-dehydride and spheridization, resulting in powders having very different morphologies than the powder made by the Armstrong method. Hydride-dehydride powders are angular and flake-like, while spheridized powders are spheres.

Fines made during the Hunter process are available and these also have very different morphology than CP titanium produced by the Armstrong Process. SEMs of CP powder made by the hydride-dehydride process and the spheridization process and Hunter fines are illustrated in FIGS. 1 to 3, respectively. The CP powder made by the Armstrong Process is not spherical nor is it angular and flake-like. Hunter fines have "large inclusions" which do not appear in the Armstrong powder, differentiating FIGS. 1-3 from Armstrong powder shown in FIGS. 4-9. Moreover, Hunter fines have large concentrations of chlorine while Armstrong CP powder has low concentrations of chlorine; chlorine is an undesirable contaminant.

6/4 powder is made by hydride-dehydride and spherization processes, but not by the Hunter process. A calcium reduction hydride-dehydride process used in Tula, Russia was identified by Moxson et al. in an article in The International Journal Of Powder Metallurgy, Vol. 34, No. 5, 1998. Moxson et al which also discloses SEMs of both CP and 6/4 in the Journal Of Metallurgy, May, 2000, both articles, the disclosures of which are incorporated by reference, taken together showing that 6/4 powder made by methods other than the Armstrong process result in powders that are very different from Armstrong 6/4 powder, both in size distribution and/or morphology and/or chemistry. In some cases, such as the calcium reduction process in Tula, Russia there are very significant differences in chemistry as well as the other differences previously mentioned. Both the hydride-dehydride and spheridization methods require Ti, Al and V to be mixed as liquids and thereafter formed into powder. Only the Armstrong Process produces alloy powder directly from gas mixtures of the alloy constituents.

Because 6/4 titanium is the most common titanium alloy used by the Department of Defense (DOD) as well as the aerospace industry and other significant industries, the production of 6/4 by the Armstrong Process is an important commercial goal.

SUMMARY OF THE INVENTION

Accordingly, a principal object of the present invention is to provide a titanium base alloy powder having lesser amounts of aluminum and vanadium with unique morphological and chemical properties.

Another object of the present invention to provide a titanium base alloy powder having about 6 percent by weight aluminum and about 4 percent by weight vanadium within current ASTM specifications.

Yet another object of the invention is to make a 6/4 alloy as set forth in which sodium is present in significantly smaller amounts than is present in CP titanium powder made by the Armstrong Process.

Still another object of the present invention is to provide a titanium base alloy powder having about 6% by weight aluminum and about 4% by weight vanadium with an alkali or alkaline earth metal being present in an amount less than about 200 ppm and the alloy powder being neither spherical nor angular or flake shaped.

A further object of the present invention is to provide a titanium base alloy powder having about 6% by weight aluminum and about 4% by weight vanadium with an alkali or alkaline earth metal being present in an amount less than about 200 ppm and having a tap density or packing fraction in the range of from about 4% to about 11%.

Yet another object of the present invention is to provide a titanium base alloy powder having about 6% by weight aluminum and about 4% by weight vanadium with an alkali or an alkaline earth metal being present in an amount less than about 200 ppm made by the subsurface reduction of chloride vapor with molten alkali metal or molten alkaline earth metal.

A final object of the present invention is to provide an agglomerated titanium base alloy powder having about 6% by weight aluminum and about 4% by weight vanadium with an alkali or alkaline earth metal being present in an amount less than about 100 ppm substantially as seen in the SEMs of FIGS. 10-12.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
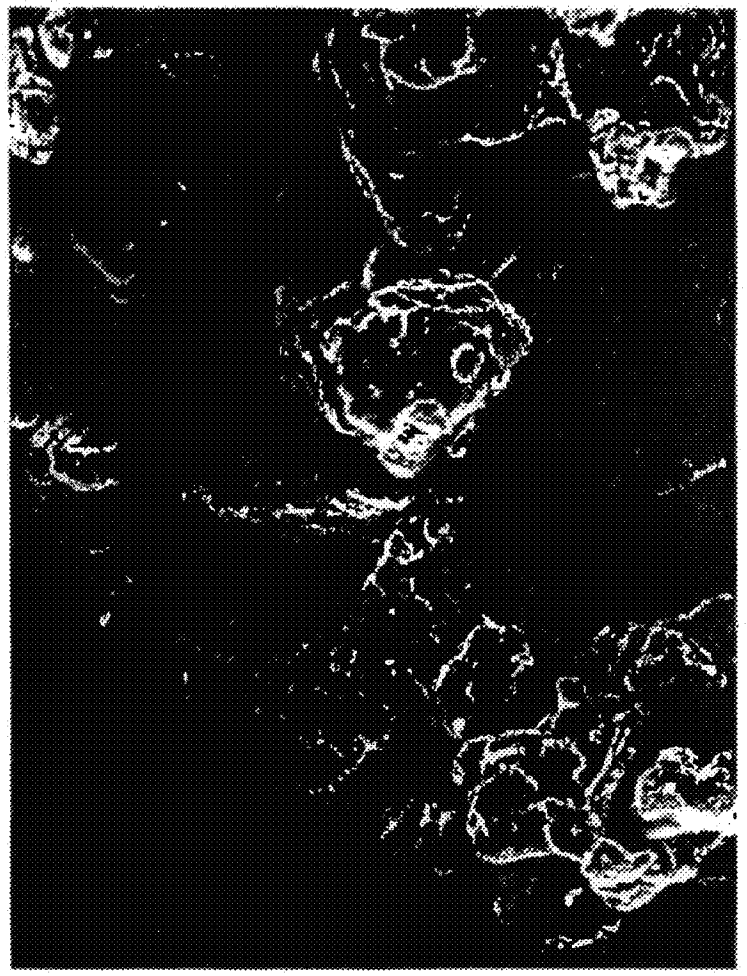
FIG. 1 is a SEM of CP powder made by the hydride-dehydride method.

As used herein, a "titanium base alloy" means any alloy having 50% or more by weight titanium. Although 6/4 is used as a specific example, other titanium base alloys are included in this invention. As seen from the previous discussion, Armstrong CP titanium powder is different from spheridized titanium powder and from hydride-dehydride titanium powder in both morphology and packing fraction or tap density. There are also differences in certain of the chemical constituents. For instance, Armstrong CP titanium powder has sodium present in the 400-700 ppm range while spheridized and hydride-dehydride powder should have none or only trace amounts. Armstrong CP titanium has little chloride concentration, on the order of <50 ppm, while Hunter fines have much larger concentrations of chlorides, on the order of 0.12-0.15 wt. %.

The equipment used to produce the 6/4 alloy is substantially as disclosed in the aforementioned patents disclosing the Armstrong Process with the exception that instead of only having a titanium tetrachloride boiler 22 as illustrated in those patents, there is also a vanadium tetrachloride boiler and an aluminum trichloride boiler which are connected to the reaction chamber by suitable valves. The piping acts as a manifold so that the gases are completely mixed as they enter the reaction chamber and are introduced subsurface to the flowing liquid sodium. It was determined during production of the 6/4 alloy that aluminum trichloride is corrosive and required special materials not required for handling either titanium tetrachloride or vanadium tetrachloride. Therefore, Hastelloy C-276 was used for the aluminum trichloride boiler and the piping to the reaction chamber.

During most of the runs the steady state temperature of the reactor was maintained at about 400° C. by the use of sufficient excess sodium. Other operating conditions for the production of the alloy were as follows:

A device similar to that described in the incorporated Armstrong patents was used except that a $VCl_4$ boiler and $AlCl_3$ boiler were provided and both gases were fed into the line feeding $TiCl_4$ into the liquid Na. The boiler pressures and system parameters are listed hereafter.

EXPERIMENTAL PROCEDURE $TiCl_4$ Boiler Pressure=500 kPa
$VCl_4$ Boiler Pressure=630 kPa
$AlCl_3$ Boiler Pressure=830 kPa
Inlet Na temperature=240° C.
Reactor Outlet Temperature=510 C.
Na Flowrate=40 kg/min
$TiCl_4$ Flowrate=2.6 kg/min For this specific experiment, a 7/32" nozzle was used in the reactor to meter the mix of metal chloride vapors. A 0.040" nozzle was used to meter the $AlCl_3$ and a 0.035" nozzle was used to meter the $VCl_4$ into the $TiCl_4$ stream. The reactor was operated for approximately 250 seconds injecting approximately 11 kg of $TiCl_4$. The salt and titanium alloy solids were captured on a wedge wire filter and free sodium metal was drained away. The product cake containing titanium alloy, sodium chloride and sodium was distilled at approximately 100 milli-torr at 550 to 575° C. vessel wall temperatures for 20 hours. Once all the sodium metal was removed via distillation, the trap was re-pressurized with argon gas and heated to 750° C. and held at temperature for 48 hours. The vessel containing the salt and titanium alloy cake was cooled and the cake was passivated with a 0.7 wt % oxygen/argon mixture. After passivation, the cake was washed with deionized water and subsequently dried in a vacuum oven at less than 100° C.

Table 2 below sets forth a chemical analysis of various runs for 6/4 alloy from an experimental loop running the Armstrong Process.

TABLE 2

Ti 6/4 FROM EXPERIMENTAL LOOP

| Run | Size | Oxygen | Sodium | Nitrogen | Hydrogen | Chloride | Vanadium | Aluminum | Carbon | Iron |
|---|---|---|---|---|---|---|---|---|---|---|
| N-269- | * | 0.187 | 0.019 | 0.006 | 0.0029 | 0.001 | 5.58 | 5.58 | 0.019 | 0.014 |
| N-269- | + | 0.113 | 0.0015 | 0.008 | 0.003 | 0.001 | 5.33 | 5.38 | 0.03 | 0.021 |
| N-269- | + | 0.128 | 0.0006 | 0.005 | 0.0037 | 0.001 | 5.84 | 5.47 | 0.039 | 0.02 |
| N-271- | + | 0.124 | 0.002 | 0.001 | 0.0066 | 0.0016 | 4.87 | 6.95 | 0.033 | 0.037 |
| N-276 | + | 0.111 | 0.0018 | | | | 4.44 | 6.04 | | |
| N-276 | + | 0.121 | 0.0018 | 0.005 | 0.0043 | 0.0005 | 4.12 | 6.35 | 0.012 | 0.016 |
| N-276 | + | 0.131 | 0.0019 | 0.003 | 0.0057 | 0.0011 | 4.03 | 5.67 | 0.012 | 0.016 |
| N-276 | + | 0.169 | 0.0026 | | | | 4.1 | 6.02 | | |
| N-276 | + | 0.128 | 0.0015 | 0.003 | 0.0042 | 0.0005 | 3.8 | 6.02 | 0.012 | 0.019 |
| N-277 | + | 0.155 | 0.0018 | 0.003 | 0.0053 | 0.0006 | 3.45 | 5.73 | 0.014 | 0.015 |

TABLE 2-continued

| Ti 6/4 FROM EXPERIMENTAL LOOP | | | | | | | | | | |
|---|---|---|---|---|---|---|---|---|---|---|
| Run | Size | Oxygen | Sodium | Nitrogen | Hydrogen | Chloride | Vanadium | Aluminum | Carbon | Iron |
| N-277 | + | 0.135 | 0.0023 | | | | 3.49 | 5.49 | | |
| N-276 | * | 0.121 | 0.0041 | 0.005 | 0.0052 | 0.0005 | 4.31 | 6.53 | 0.02 | 0.015 |
| N-276 | * | 0.134 | 0.0075 | | | | 3.81 | 5.92 | | |
| N-276 | * | 0.175 | 0.014 | 0.012 | 0.0066 | 0.0005 | 3.96 | 6.01 | | |
| N-276 | * | 0.187 | 0.046 | 0.007 | 0.0081 | 0.0005 | 3.95 | 6.05 | | |
| N-277 | * | 0.141 | 0.0022 | 0.004 | 0.0038 | 0.0026 | 3.65 | 5.42 | | |
| Mean | | 0.14125 | 0.0069125 | 0.0051667 | 0.00495 | 0.00095 | 4.295625 | 5.914375 | 0.0212222 | 0.0192222 |
| Stand dev. | | 0.0253811 | 0.0116064 | 0.0028868 | 0.0015952 | 0.000626 | 0.7343838 | 0.4335892 | 0.0102808 | 0.0071024 |

* = BULK
+ = SMALL

As seen from the above Table 2, the sodium levels for 6/4 are very low on the order of 69 ppm and for certain runs, sodium levels have been undetectable. This result was unexpected because over two hundred runs of CP titanium have been made using the Armstrong Process, and sodium has always been present in the range of from about 400-700 ppm. Therefore, the lack of sodium in the 6/4 alloy was not only unexpected but an important consideration since sodium may adversely affect the welds of CP titanium.

Other important aspects shown in Table 2 are the percentages of vanadium and aluminum in the 6/4 showing an average of about 5.91% aluminum and about 4.29% vanadium for all of the runs. The runs reported in Table 2 were made with an experimental loop and the valving and control systems for metering the appropriate amount of both vanadium and aluminum were rudimentary. Advanced valving systems have now been installed to control more closely the amount of vanadium and aluminum in the 6/4 produced from the Armstrong Process, although even with the rudimentary control system, the 6/4 alloy was within ASTM specifications. Also of significance is the low iron and chloride content of the 6/4 alloy.

An additional unexpected feature of the 6/4 alloy compared to the CP titanium is the surface area, as determined using BET Specific Surface Area analysis with krypton as the adsorbate. In general, the specific surface area of the 6/4 alloy is much larger than the CP titanium and this also was unexpected. Surface analysis of CP particles which were distilled overnight (about 8-12 hours) between 500-575° C. were 0.534 square meters/gram whereas 6/4 alloy measured 3.12 square meters/gram, indicating that the alloy is significantly smaller than the CP.

Figure 2:
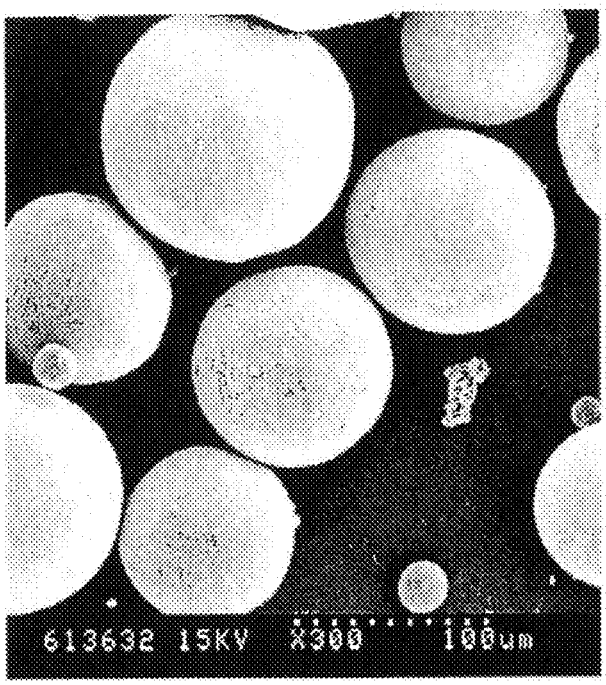
FIG. 2 is a SEM of CP powder made by the spheridization method.
Figure 2:
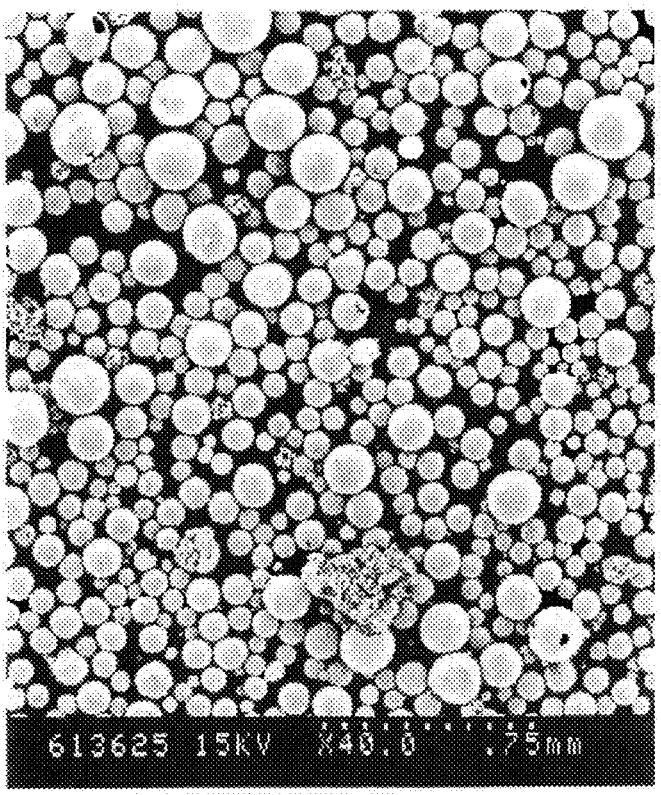
Figure 3:
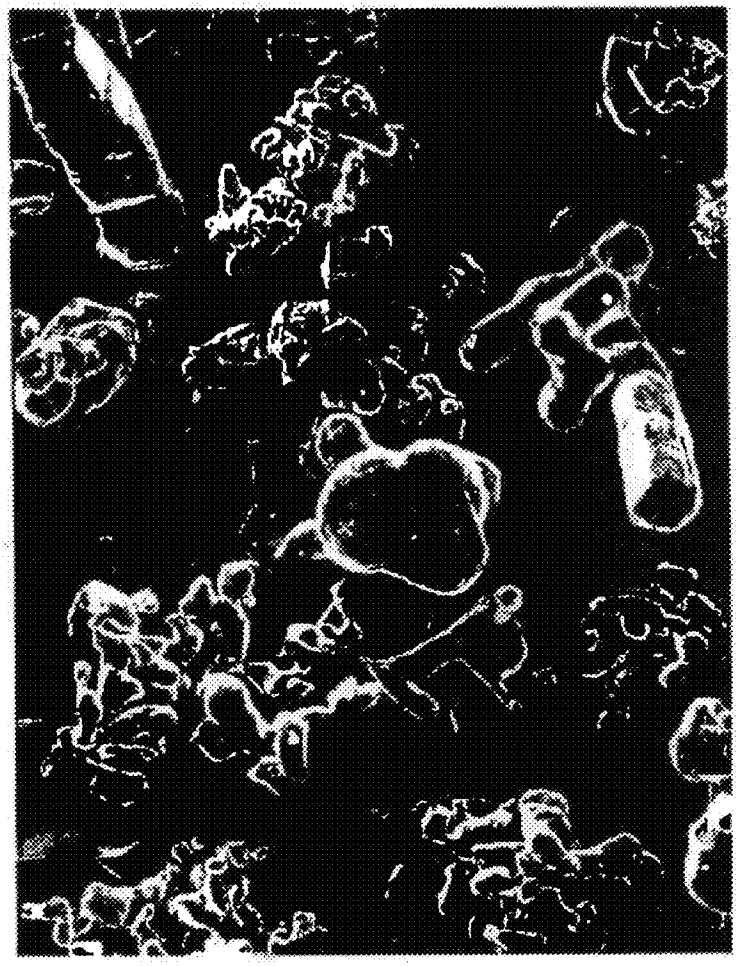
FIG. 3 is a SEM of CP powder from the Hunter Process.
Figure 4:
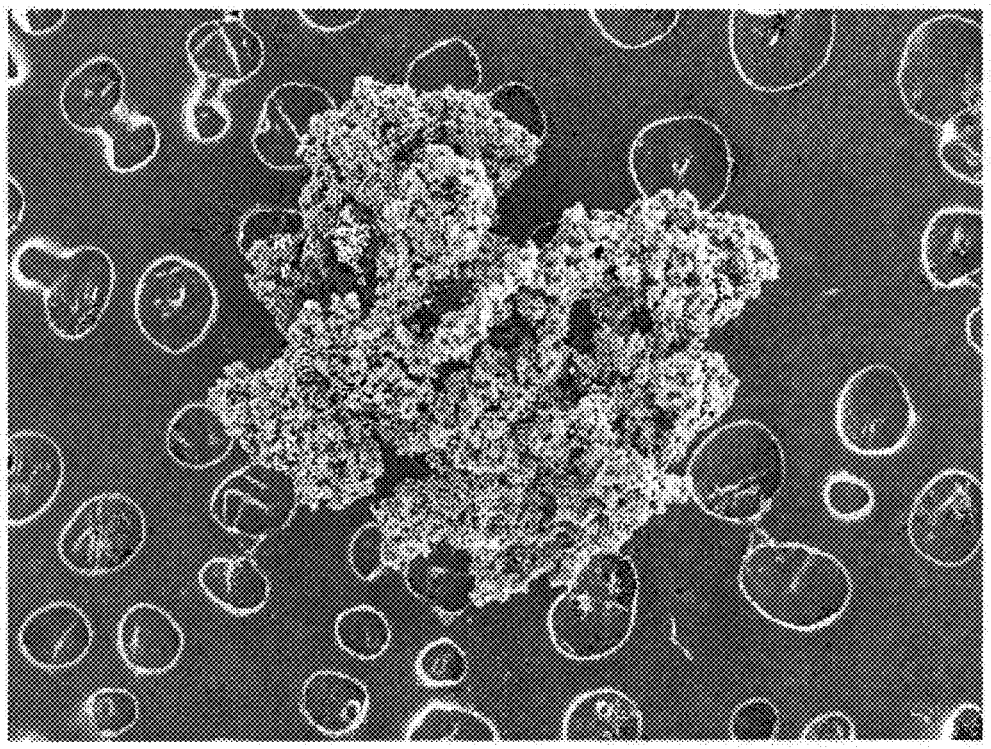
FIG. 4-6 are SEMs of Armstrong CP distilled, dried and passivated.
Figure 5:
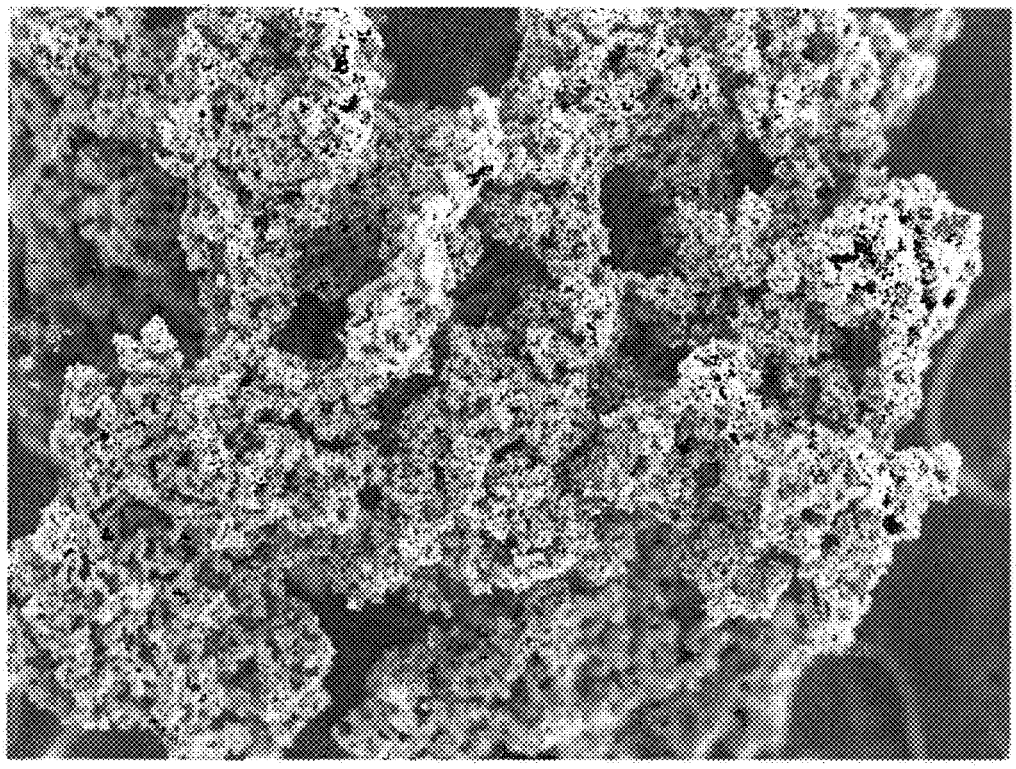
Figure 6:
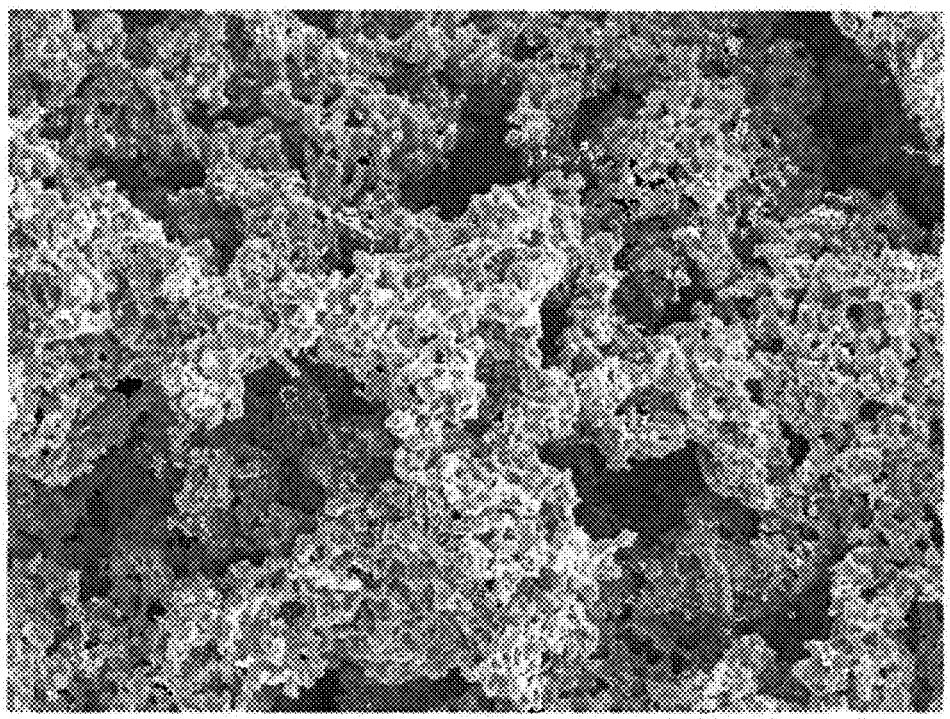
Figure 7:
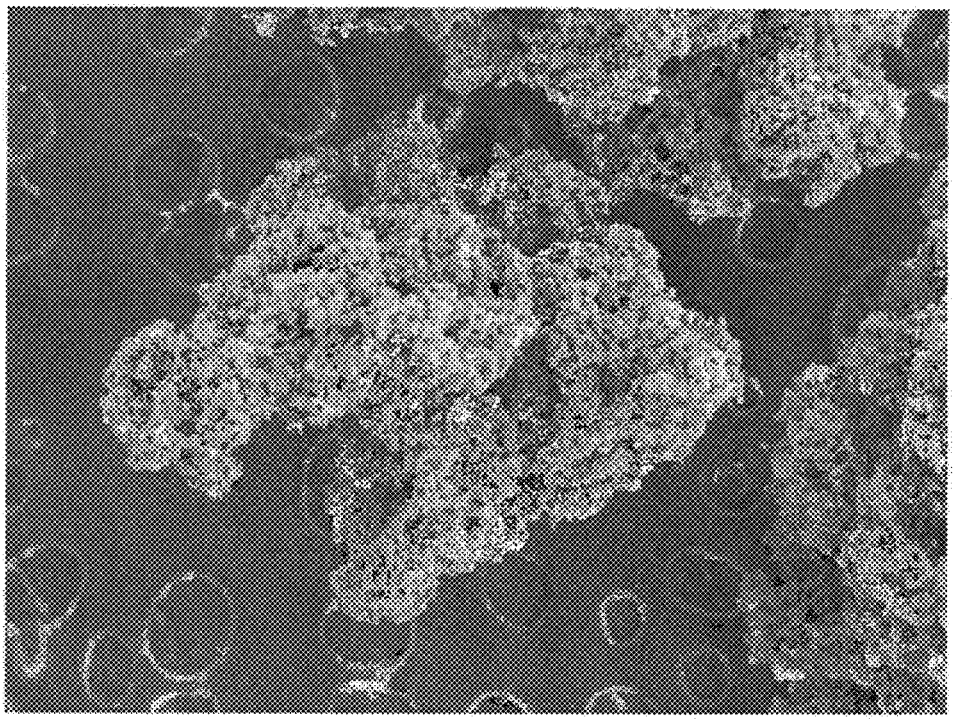
FIG. 7-9 are SEMs of Armstrong CP distilled, dried, passivated and held at 750° C. for 48 hours.
Figure 8:
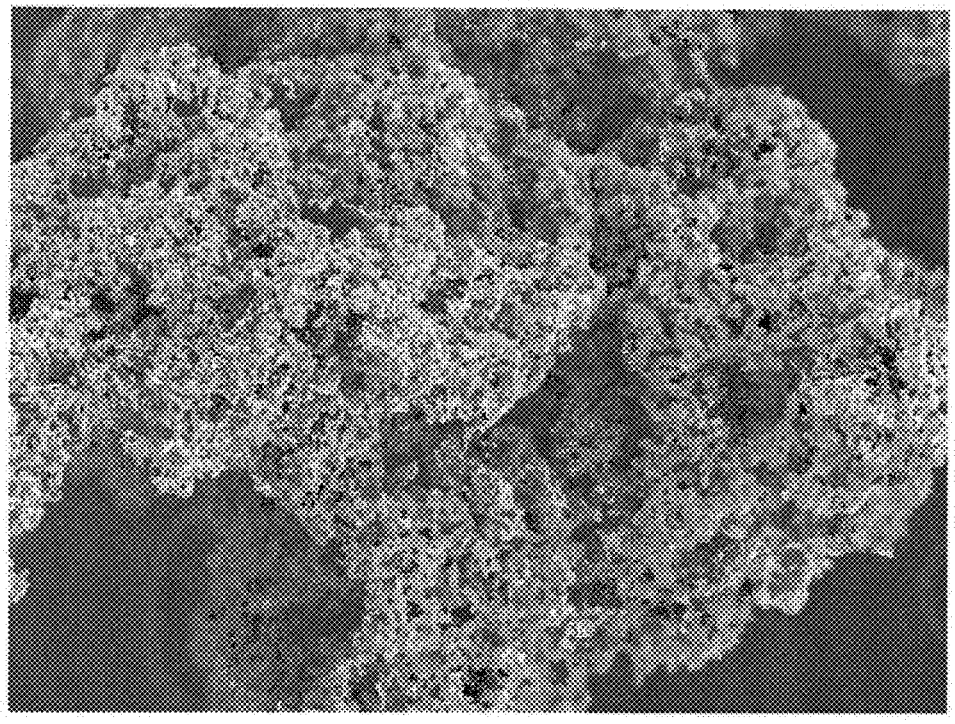
Figure 9:
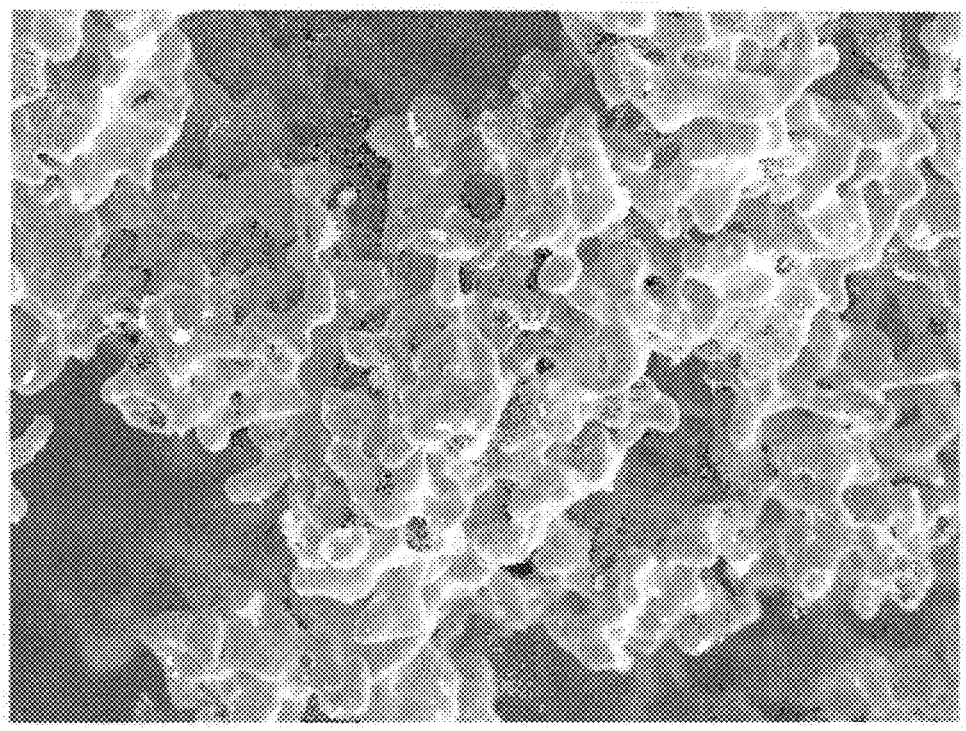
Figure 10:
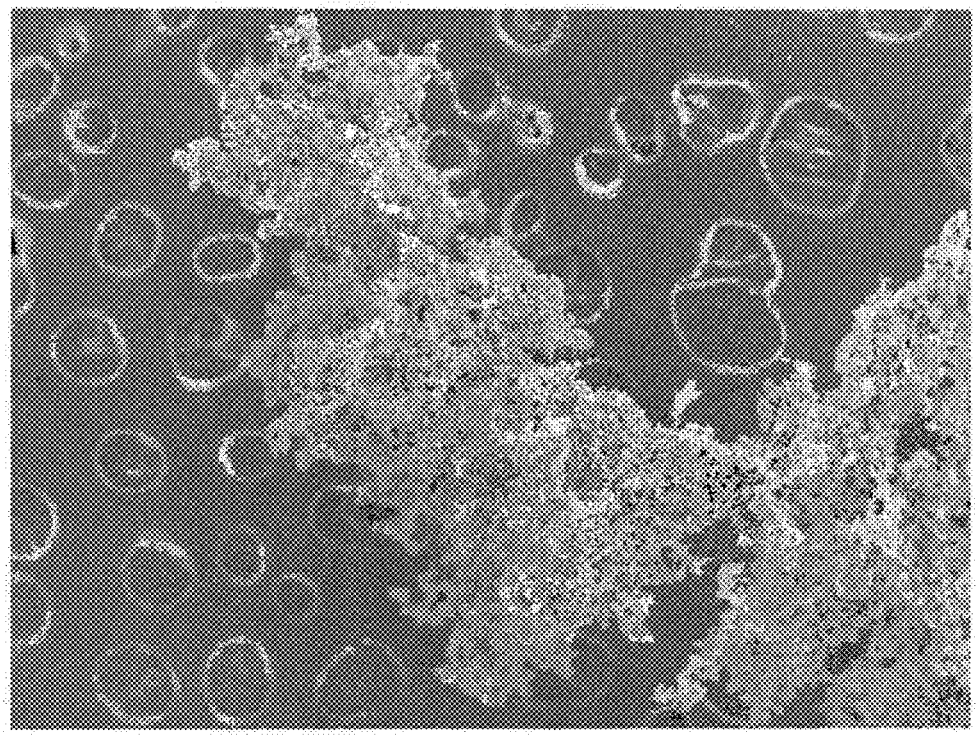
FIG. 10-12 are SEMs of Armstrong 6/4 distilled, dried, passivated and held at 750° C. for 48 hours.
Figure 11:
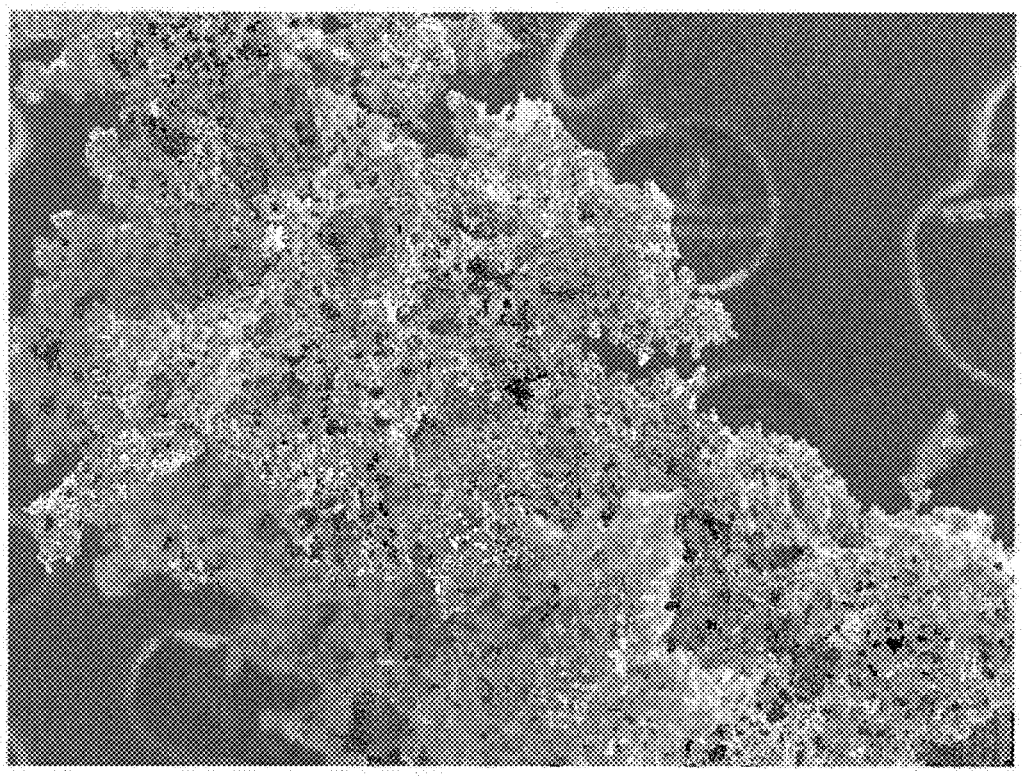
Figure 12:
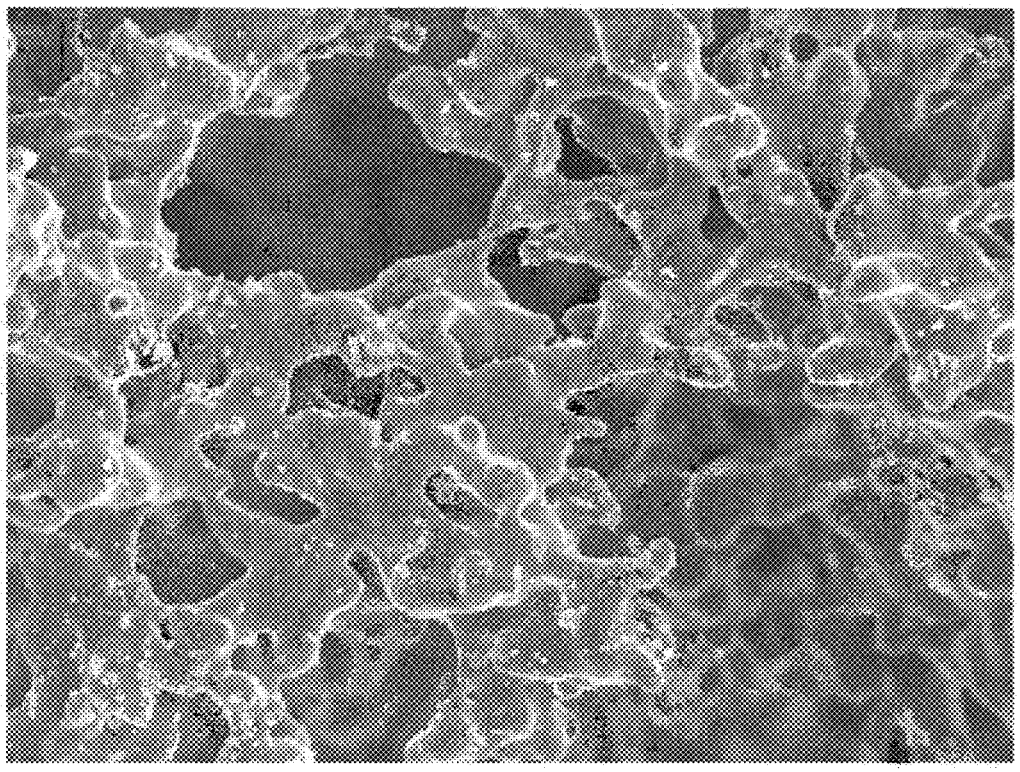

The SEMs show that the 6/4 powder is "frillier" than CP powder, see FIGS. 4-9 and 10-12. As reported by Moxson et al., *Innovations in Titanium Powder Processing* in the Journal of Metallurgy May 2000, it is clear that by-product fines from the Kroll or Hunter Processes contain large amounts of undesirable chlorine which is not present in the CP titanium powder made by the Armstrong Process (see Table 1). Moreover, the morphology of the Hunter and Kroll fines, as previously discussed, is different from the CP powder made by the Armstrong Process. Neither the Kroll nor the Hunter process has been adapted to produce 6/4 alloy. Alloy powders have been produced by melting prealloyed stock and thereafter using either gas atomization or a hydride-dehydride process (MHR). The Moxson et al. article discloses 6/4 powder made in Tula, Russia and as seen from FIG. 2 in that article, particularly FIGS. 2*c* and 2*d* the powders made by Tula Hydride Reduction process are significantly different than those made by the Armstrong Process. Moreover, referring to the Moxson et al. article in the 1998 issue of the International Journal of Powder Metallurgy, Vol. 4, No. 5, pages 45-47, it is seen that the chemical analysis for the pre-alloy 6/4 powder produced by the metal-hydride reduction (MHD) process contains exceptional amounts of calcium and also is not within ASTM specifications for aluminum.

Because the 6/4 alloy made by the Armstrong Process is made without the presence of either calcium or magnesium, these metals should be present, if at all, only in trace amounts and certainly much less than 100 ppm. Sodium which would be expected to be present in significant quantities based on the operation of the Armstrong Process to produce CP titanium in fact is present only at minimum quantities in the 6/4 alloy. Specifically, sodium in the 6/4 alloy made by the Armstrong Process is almost always present less than 200 ppm and generally less than 100 ppm. In some instances, 6/4 alloy has been produced using the Armstrong Process in which sodium is undetectable so that this is a great and unexpected advantage of the 6/4 alloy vis a vis CP titanium made by the Armstrong Process.

Both the Armstrong CP titanium and 6/4 alloy have tap densities or packing fractions in the range of from about 4% to 11%. This tap density or packing fraction is unique and inherent in the Armstrong Process and, while not advantageous particularly with respect to powder metallurgical processing, distinguishes the CP powder and the 6/4 powder made by the Armstrong Process from all other known powders.

As is well known in the art, solid objects can be made by forming 6/4 or CP titanium into a near net shapes and thereafter sintering, see the Moxson et al. article and can also be formed by hot isostatic pressing, laser deposition, metal injecting molding, direct powder rolling or various other well known techniques. Therefore, the titanium alloy powder made by the Armstrong method may be formed into a sintered product or may be formed into a solid object by well known methods in the art and the subject invention is intended to cover all such products made from the powder of the subject invention.

While the invention has been particularly shown and described with reference to a preferred embodiment hereof, it will be understood by those skilled in the art that several changes in form and detail may be made without departing from the spirit and scope of the invention which includes titanium base alloys having lesser amounts of aluminum and vanadium and is specifically not limited to the specific alloys disclosed.

We claim:

1. A method of forming a titanium base alloy powder, the method comprising:

subsurface reduction of a chloride vapor with a molten alkali metal or molten alkaline earth metal to form reaction products comprising pre-alloy particles and a salt of the alkali metal or the alkaline earth metal, a majority of the pre-alloy particles having a composition of at least 50% by weight of titanium, 5.38% or more by weight of aluminum, and 3.45% or more by weight of vanadium, wherein the total amount of aluminum and vanadium is less than about 20% by weight; and recovering the pre-alloy particles from the reaction products to produce a titanium base alloy powder containing less than about 200 ppm alkali or alkaline earth metal and a surface area as determined by BET analysis of at least about 3 square meters per gram after distillation of the powder at temperatures between about 500° C. and about 575° C. for about 8 to about 12 hours.

2. The method of claim 1, wherein the titanium base alloy powder meets ASTM B265 grade 5 chemical specifications.

3. The method of claim 1, wherein the alkali metal is Na, K or mixtures thereof and the alkaline earth metal is Mg, Ca, Ba or mixtures thereof.

4. The method of claim 1, wherein the titanium alloy powder is in agglomerates having an average mean diameter as measured by sieve analysis greater than about 50 microns.

5. The method of claim 1, wherein the titanium alloy powder contains less than about 100 ppm sodium, magnesium, calcium.

6. The method of claim 1, further comprising forming the titanium alloy powder into a sintered product.

7. A method of forming a titanium base alloy powder, the method comprising:

subsurface reduction of a chloride vapor with a molten alkali metal or molten alkaline earth metal to form reaction products comprising pre-alloy particles and a salt of the alkali metal or the alkaline earth metal, a majority of the pre-alloy particles having a composition of at least 50% by weight of titanium, about 5.38% to 6.95% by weight of aluminum, and about 3% to 5% by weight of vanadium; and recovering the pre-alloy particles from the reaction products to produce a titanium base alloy powder containing less than about 200 ppm alkali or alkaline earth metal and a surface area as determined by BET analysis of at least about 3 square meters per gram after distillation of the powder at temperatures between about 500° C. and about 575° C. for about 8 to about 12 hours.

8. The method of claim 7, wherein the titanium base alloy powder meets ASTM B265 grade 5 chemical specifications.

9. The method of claim 7, wherein the alkali metal is Na, K or mixtures thereof and the alkaline earth metal is Mg, Ca, Ba or mixtures thereof.

10. The method of claim 7, wherein the titanium alloy powder is in agglomerates having an average mean diameter as measured by sieve analysis greater than about 50 microns.

11. The method of claim 7, wherein the titanium alloy powder contains less than about 100 ppm sodium, magnesium, calcium.

12. The method of claim 7, further comprising forming the titanium alloy powder into a sintered product.

* * * * *